US010609767B1

(12) United States Patent
Trost

(10) Patent No.: US 10,609,767 B1
(45) Date of Patent: Mar. 31, 2020

(54) PORTABLE HANDHELD PORTABLE HEATING STICK

(71) Applicant: Shelley Ann Trost, Goleta, CA (US)

(72) Inventor: Shelley Ann Trost, Goleta, CA (US)

( * ) Notice: Subject to any disclaimer, the term of this patent is extended or adjusted under 35 U.S.C. 154(b) by 0 days.

(21) Appl. No.: 15/675,569

(22) Filed: Aug. 11, 2017

(51) Int. Cl.
*H05B 3/80* (2006.01)

(52) U.S. Cl.
CPC ..... *H05B 3/80* (2013.01)

(58) Field of Classification Search
CPC ..... H05B 3/78; H05B 3/80; H05B 3/82
See application file for complete search history.

(56) References Cited

U.S. PATENT DOCUMENTS 2,918,561 A * 12/1959 Perez ..... A47J 37/00 219/523
4,857,702 A * 8/1989 Cafaro ..... A45D 1/04 219/225
5,968,396 A * 10/1999 Rodriguez ..... H05B 3/80 219/437
10,187,929 B1 * 1/2019 McFadden ..... H05B 3/06
2008/0047498 A1 * 2/2008 Hollyday ..... A01K 7/027 119/73
2010/0274162 A1 * 10/2010 Evans ..... A61F 7/007 601/15
2011/0315669 A1 * 12/2011 Barlow ..... H05B 3/58 219/201

* cited by examiner

*Primary Examiner* — Charlie Y Peng

(57) ABSTRACT

A compact portable heating unit which can be inserted into a container of liquid for the purpose of heating liquids on-the-go. The element has a heating tip and a cylinder shape for easy fit into a container of liquid. The portable heating unit has a battery for powering the heating element, an on/off switch, a power percentage gauge, on/off indicator light, an charging port, and a protective cap. The unit can be either USB charged or sonic based.

1 Claim, 1 Drawing Sheet

PORTABLE HANDHELD PORTABLE HEATING STICK

CROSS-REFERENCE TO RELATED APPLICATIONS

None

FEDERALLY FUNDED

N/A

SEQUENCING

N/A

BACKGROUND OF INVENTION

This invention came out of a supply/demand idea. There is a need for this type of item. I believe the demand will be great.

SUMMARY OF INVENTION

The Portable Handheld Heating Stick is an apparatus used for heating a container of liquid. Liquid can be heated quickly on-the-go.

An item comprising a heating tip, a barrel, housing a temperature display, solar panel, USB or sonic port, battery compartment, low/high temperature control, power percentage indicator, on/off indicator light, and a removable cap. Item will cool quickly. The item is battery operated. It has a USB or sonic port on one end to charge opposite of the heating tip. Can also be solar charged. The item is designed to place in liquid, turn apparatus on and liquid is thoroughly heated.

The scope of use: Designed to heat up individual liquids from a cup of coffee, tea, soup, a baby bottle, on camping trips, survival trips, or with military personnel out in the field. Item use is limitless and reaches many different demographic groups.

The function of the Portable Handheld Heating Stick is a portable apparatus to heat liquids on-the-go. Can be solar, USB or sonic charged.

DETAILED DESCRIPTION OF INVENTION

Figure 1A:
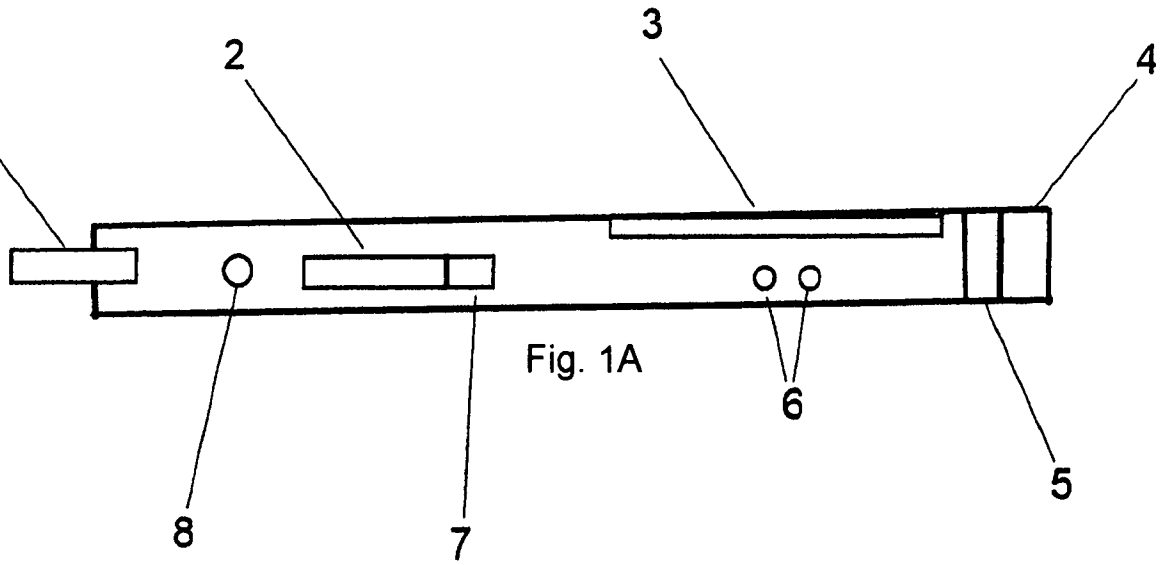
FIG. 1A shows the portable handheld heating stick.
Figure 1B:
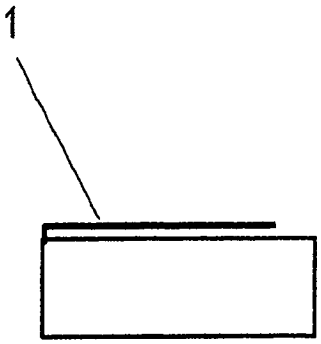
FIG. 1B shows a removable cap.

Listing of Reference Numerals in the Drawings:

FIG. 1A

1. Heating tip (may be sonic tip/may design safety feature to go off automatically when not in liquid)

2. Temperature Display (warm to hot)
3. Solar Panel (to charge battery)
4. USB or Sonic Port (for charging unit)
5. Battery Compartment
6. Low Temperature/High Temperature Control
7. Power Percent Indicator
8. On/off Power & Indicator Light

FIG. 1B

10. Removable Cap (to protect heating tip)

The item is about the size of a marker pen. The following elements are included:

Heating element—The tip of the item (the heating element) will be submerged into the liquid to heat up your liquid or food.

Temperature display—The temperature display shows what temperature the element is at. Temperature variants will be from warm to hot.

Solar panel for charging—The solar panel will allow for daylight charging. Can be used outdoors when no electricity is available.

USB or Sonic Port—You can charge the heat element through USB or Sonic port depending upon design.

Battery compartment—The battery allows for charge to be held whether solar, USB or sonic.

Low temperature/high temperature buttons—These two buttons give you the warming option or a higher temperature.

Power indicator—The power indicator will show when the unit needs a charge or is fully charged.

Indicator Light—shows if the unit is on or off.

Removable Cap—Protects and covers tip when not in use. Easy carry in purse or pocket.

The invention claimed is:

1. A compact, portable apparatus for heating a liquid comprising:
- a cylinder-shaped housing adapted for insertion into the liquid and holding the following:
- a heating tip which when turned on and placed in the liquid will heat the liquid to taste;
- a battery;
- a temperature display;
- a solar panel for charging the battery;
- a USB and/or sonic charging port allows the battery to be charged by electricity or a sonic unit,
- a high/low temperature control;
- a power percentage indicator shows if the battery needs to be recharged;
- an on/off indicator light; and
- a removable cap.

* * * * *